United States Patent [19]

Cosentino

[11] 4,235,335

[45] Nov. 25, 1980

[54] RIBBON PACKAGE

[76] Inventor: Cesare C. Cosentino, 45 Grandview Ave., Thornhill, Ontario, Canada

[21] Appl. No.: 18,257

[22] Filed: Mar. 7, 1979

[30] Foreign Application Priority Data

Apr. 21, 1978 [CA] Canada ..... 301668

[51] Int. Cl.[3] ..... B65D 85/67; B65D 85/671

[52] U.S. Cl. ..... 206/389; 206/413; 206/813

[58] Field of Search ..... 206/389, 413, 414, 813; 242/1, 68.5

[56] References Cited

U.S. PATENT DOCUMENTS

| | | | |
|---|---|---|---|
| 2,119,163 | 5/1938 | Herrmann et al. | 242/68.5 |
| 2,175,045 | 10/1939 | Vogel | 206/389 |
| 2,657,795 | 11/1953 | Calabrese | 242/1 |
| 2,797,804 | 7/1957 | Pomeroy et al. | 206/413 |
| 2,874,831 | 2/1959 | Flanagan | 206/389 |
| 3,368,669 | 2/1968 | Anderson et al. | 242/1 |

FOREIGN PATENT DOCUMENTS

| | | | |
|---|---|---|---|
| 587565 | 4/1925 | France | 206/413 |

*Primary Examiner*—William T. Dixson, Jr.
*Attorney, Agent, or Firm*—D. W. Eggins

[57] ABSTRACT

A simple, inexpensive package for dispensing a ribbon of magnetic tape or other thin non-adhesive material is disclosed. The package includes a roll of ribbon and a pair of annular paperboard sheets which each have a pressure-sensitive adhesive surface. To form the package, the adhesive surfaces are pressed against the respective flat surfaces of the roll. The adhesive is chosen so that the adherence of the sheets to the edges of the aligned ribbon coils is sufficient to maintain the ribbon in coiled condition but insufficient to prevent it from being progressively dispensed by drawing its free end away from the roll.

7 Claims, 4 Drawing Figures

FIG 1
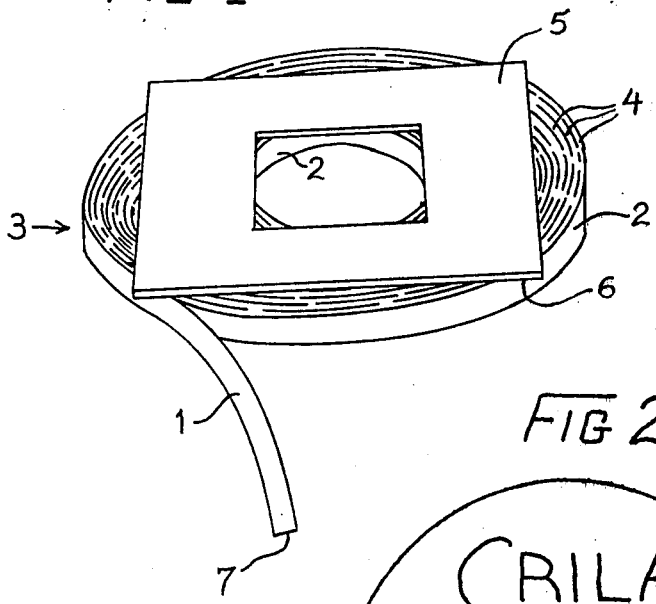
FIG 2
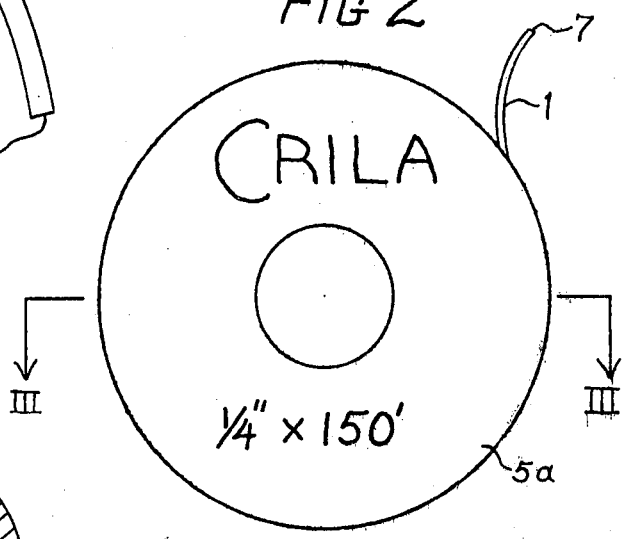
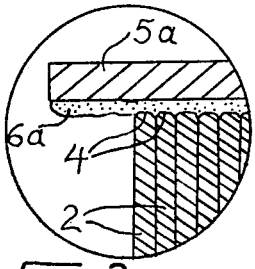
FIG 3a
FIG 3
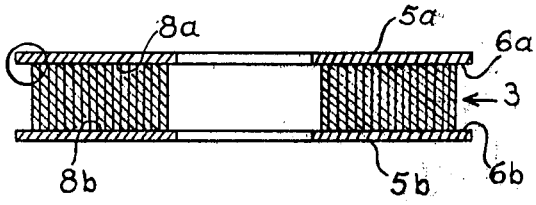

RIBBON PACKAGE

BACKGROUND OF THE INVENTION

This invention relates to a packaging method and a package for dispensing a ribbon of thin non-adhesive material. The invention is particularly well-suited for dispensing tape used in forming decorative stripes on motor vehicle bodies, magnetic tape used in sound recording, fabric ribbon for clothing, and the like. For convenience and for the purpose of the present disclosure, the term "ribbon" will be sometimes used to designate such materials, it being understood that when so used, this term is intended to embrace all other similar and equivalent materials. Because ribbons of this kind are, unlike electrical tape and the like, non-adhesive and have little tendency to adhere to one another, they cannot easily be maintained in a coiled condition while being dispensed unless special packaging is used.

In the past, many types of packages have been developed which permit dispensing from a roll formed of coils of ribbon which do not adhere to each other. In the case of decorative tape used by commercial applicators in forming stripes on vehicle bodies, a roll of about 150 feet of this tape has frequently been placed in a flat, box-like container to prevent uncontrolled uncoiling of the ribbon. The container was completely enclosed save for a slot in a wall thereof through which the tape was progressively drawn whenever desired and cut off to a desired length, the roll gradually unwinding and reducing in size inside the container. As the roll reduced in size and due to movement of the container from place to place, the projecting free end of tape frequently slipped back within the container, thus necessitating opening of the container or at least rotation of the roll in order to find the free end of the tape to permit dispensing thereof once again.

More importantly, the use of such prior art containers gives rise to significant cost for the manufacturer of such decorative tapes, which he typically supplies to commercial applicators (retail firms that specialize in applying stripes to vehicle bodies) in a variety of colours and in tape widths ranging from 1/16" to 2". Typical laminated sheet material from which the manufacturer cuts the decorative tape ribbons in these widths is available from 3M Canada Limited under trade marks such as SCOTCH CAL and CONTROLTAC. Because both surfaces of such tapes are non-adhesive when dispensed, the containers in which they are enclosed must be close fitting to prevent uncoiling and ravelling of tape within the containers. For this reason the manufacturer must maintain an expensive inventory of containers in a number of different widths.

OBJECTS OF THE INVENTION

An important object of this invention is to provide a method of packaging ribbon, of the type referred to, which is inexpensive, simple to use and which, in these respects, is generally superior to packaging with the prior art containers as described hereinabove. A related object is to provide an inexpensive and simple package, in accordance with the foregoing method, for dispensing a ribbon of thin non-adhesive material.

Another object resides in the provision of a package, of the type referred to, which can be used for packaging ribbons of many different widths.

Another object of the invention is the provision of a package that is well-suited both for retail display and for use in packaging larger ribbon quantities for dispensing by commercial firms, such as commercial applicators of decorative tape ribbons to vehicle bodies.

SUMMARY OF THE INVENTION

To achieve the foregoing and other objects, and to overcome the disadvantages of the prior art described hereinabove, the present invention provides a method of packaging a ribbon of thin non-adhesive material to permit dispensing thereof which comprises the steps of forming coils of said ribbon into a roll, the edges of said coils being substantially aligned to form a substantially flat surface on one side of said roll, and pressing a flat adhesive surface of a member into adherence with said flat surface, the adherence of said flat adhesive surface to said edges being sufficient to maintain said ribbon in a coiled condition but insufficient to prevent progressive dispensing thereof. Preferably, the member is a sheet of paperboard or the like adapted to be pressed into adherence with a major portion of the aforesaid flat surface.

The invention also provides a package for dispensing a ribbon of thin non-adhesive material comprising a roll formed of coils of ribbon, the edges of said coils being substantially aligned to form a substantially flat surface on one side of the roll, and a member having a flat adhesive surface, said flat adhesive surface being pressed into adherence with said flat surface, the adherence of said flat adhesive surface to said edges being sufficient to maintain said ribbon in a coiled condition but insufficient to prevent progressive dispensing thereof. Preferably, the member is a paperboard sheet adapted to adhere to a major portion of the flat surface of the roll. Advantageously, the flat adhesive surface is formed by a coating of pressure-sensitive adhesive on a surface of the paperboard sheet.

According to a preferred embodiment, the invention provides a package for dispensing a ribbon of thin non-adhesive material of substantially uniform width comprising a roll formed of coils of said ribbon, the edges of said coils being substantially aligned to form a substantially flat surface on each side of said roll, and a pair of annular sheets adapted to cover said flat surface, each annular sheet having an adhesive surface, one adhesive surface being pressed into adherence with the flat surface on one side of said roll, the other adhesive surface being pressed into adherence with the flat surface on the other side of said roll, the adherence of the adhesive surfaces to said edges being sufficient to maintain said ribbon in a coiled condition but insufficient to prevent progressive dispensing thereof. Preferably, each annular sheet is comprised of paperboard having a coating of pressure sensitive adhesive on one surface thereof to form the adhesive surface of the annular sheet.

DESCRIPTION OF THE DRAWINGS

For a better understanding of the invention and its other advantages and objects, reference may be made to the following detailed description, taken in conjunction with the accompanying drawings, in which:

FIG. 1 is a perspective view of a package in accordance with the present invention;

FIG. 2 is a plan view of a package in accordance with a preferred embodiment of the invention;

FIG. 3 is a sectional view taken along line III—III of FIG. 2, and

FIG. 3*a* is an enlarged view of the circled portion in FIG. 3.

Referring now to the drawings, FIG. 1 shows an embodiment of a package for dispensing a ribbon 1 of thin non-adhesive material which may, for example, be a decorative tape ribbon used for applying decorative striping to motor vehicle bodies, magnetic tape used in sound recording, or fabric ribbon used for clothing.

Concentric coils 2 of ribbon 1 are formed into a roll 3 which may be of generally circular shape as illustrated or may be more elliptical, as is often the case for fabric ribbons. In any case, each coil is defined by one revolution of ribbon around the central area of the roll. As shown in FIG. 1, the upper edges 4 of coils 2 are substantially aligned to form a substantially flat upper surface of roll 3.

Member 5 has a substantially flat adhesive lower surface 6. While member 5 is illustrated as a generally rectangular sheet of paperboard (e.g. 2 ply bristol board), it may be composed of any of a number of materials such as metal, plastic, or the like and may be formed in a variety of three-dimensional shapes provided that its lower surface 5 is substantially flat to permit contact with the majority of edges 4 of coils 2 which define a substantially flat upper surface of roll 3. Adhesive lower surface 6 is preferably formed by a coating of a pressure sensitive adhesive.

While keeping roll 3 in coiled condition, the flat adhesive surface 6 of member 5 is pressed into adherence with the flat surface formed by edges 4 of coils 2. By a suitable choice of adhesive, the adherence of adhesive surface 6 to edges 4 is sufficient to maintain the roll 3 of ribbon 1 in its coiled condition, but is insufficient to prevent progressive dispensing of ribbon 1 by drawing on its free end 7. Thus a length of ribbon may be dispensed by merely pulling free end 7 to overcome the adherence of surface 6 to the edges 4 of successively smaller coils 2 while the remaining coils on roll 3 are held in coiled condition by adherence to adhesive surface 6. When a desired length of ribbon 1 has been dispensed in this manner and severed from roll 3, any excess portion of ribbon 1 left dangling may be coiled around the remaining part of the roll and pushed up into adherence of the upper edges 4 of these newly-formed coils with adhesive surface 6.

As will be apparent, the choice of adhesive applied to surface 6 may depend on the type of ribbon to be dispensed. For example, if the ribbon is composed of a sturdy non-porous material then the adhesive may be of a type which hardens with time or due to contact with air. If the ribbon material is of a type which readily stretches under tension, it may be preferable to use a pressure-sensitive (i.e. non-hardening) adhesive of low adhesive strength in order to avoid undesirable elongation of the adhering edge of ribbon 1 during dispensing. Moreover, and especially for porous ribbon materials such as fabric, it is often desirable to use an adhesive which has higher cohesiveness than adhesiveness to ribbon 1 to minimize staining of dispensed ribbon. Of course, where prolonged storage of the packaged ribbon is intended, it is advisable to choose an adhesive which does not tend to deteriorate during such storage so as to leave objectionable residue on the ribbon when it is subsequently dispensed. Where the ribbon is composed of a springy material (e.g. metal) of relatively high density, it may be desireable to use a member 5 of compressible material (e.g. foam rubber) covered with a thick coating of adhesive in order that, upon pressing surface 6 against edges 4, the adhesive surface 6 will deform into the grooves between the edges 4 and thereby more strongly hold the ribbon in its coiled condition.

It is preferable that adhesive surface 6 adhere to the edges 4 of the majority of coils 2 of roll 3 in order that, as dispensing progresses, most of the remaining coils on roll 3 be maintained in coiled condition on the roll. For this reason, surface 6 should of such a size and should be so located on the flat upper surface of roll 3 as to adhere to the majority of coils 2 between the centre of roll 3 and its outermost periphery. As illustrated in FIG. 1, surface 6 is, in fact, adapted to adhere to a major portion of the flat upper surface of the roll.

FIGS. 2, 3 and 3*a* illustrate a preferred embodiment of the novel package for dispensing a ribbon 1 of the kind used in forming decorative stripes on motor vehicle bodies. Such ribbon is of substantially uniform width and is formed by laminating the adhesive surface of a decorative layer with a removable isolating layer, whereby both surfaces of the resulting ribbon 1 are non-adhesive.

Roll 3 is formed of coils 2 of ribbon 1 in a typical quantity of about 150 feet. The upper and lower edges 4 (as viewed in FIGS. 3 and 3*a*) of coils 2 are substantially aligned to form a substantially flat surface 8*a*, 8*b* on each side of roll 3.

Reference characters 5*a*, 5*b* denote a pair of annular sheets, preferably of paperboard, having adhesive surfaces 6*a*, 6*b*, respectively. In order to package the ribbon, adhesive surface 6*a* is merely pressed into adherence with upper edges 4 which form flat surface 8*a* and adhesive surface 6*b* is pressed into adherence with lower edges 4 which form flat surface 8*b*.

Adhesive surfaces 6*a*, 6*b* are preferably formed by coatings of a pressure-sensitive adhesive which is chosen so that the adherence of surfaces 6*a*, 6*b* to upper and lower edges 4 is sufficient to maintain ribbon 1 in a coiled condition but is insufficient to prevent progressive dispensing of ribbon 1 upon drawing its free end 7 away from roll 3.

As illustrated, annular sheets 5*a*, 5*b* are of a size and are so located as to entirely cover the flat surfaces 8*a*, 8*b*, respectively. If desired, and especially where retail display is intended, sheets 5*a*, 5*b* may be pre-printed with advertising material, directions for use, and other information before the sheets are applied to sufaces 8*a*, 8*b*. Since sheets 5*a*, 5*b* are inexpensive and simple to apply to rolls of ribbon of many widths, the resulting packages are little more expensive than the unpackaged rolls while still permitting controlled dispensing of ribbon as desired.

The present invention will thus be seen to accomplish the objects enumerated above. It will be realized, however, that various changes and substitutions may be made to the specific embodiments disclosed herein for the purpose of illustrating the principles of this invention. Accordingly, this invention is intended to include all modifications encompassed within the spirit and scope of the appended claims.

What is claimed is:

1. A package for dispensing a singular ribbon of thin non-adhesive material, said package comprising:

a roll formed of a continuous coil of said ribbon, the edges of said coil being substantially aligned to form a substantially flat surface on one side of said roll, and a member having a flat pressure sensitive adhesive surface, said flat adhesive surface being pressed into adherence with said flat surface, the adherence of said flat adhesive surface to said edges being sufficient to maintain said ribbon in a coiled condition but insufficient to prevent progressive dispensing thereof, said pressure sensitive adhesive permitting re-attachment of said flat member to said edges.

2. A package as set forth in claim 1, said sheet being comprised of paperboard.

3. A package as set forth in claim 1, said member being a sheet adapted to adhere to a major portion of said flat surface of said roll.

4. A package as set forth in claim 1, said flat adhesive surface being deformable into grooves between the edges forming said flat surface upon pressing of said flat adhesive surface thereagainst.

5. A package for dispensing a ribbon of thin non-adhesive material of substantially uniform width, said package comprising:

a roll formed of coils of said ribbon, the edges of said coils being substantially aligned to form a substantially flat surface on each side of said roll, and a pair of annular sheets adapted to cover said flat surface, each annular sheet having an adhesive surface, one adhesive surface being pressed into adherence with the flat surface on one side of said roll, the other adhesive surface being pressed into adherence with the flat surface on the other side of said roll, the adherence of the adhesive surfaces to side edges being sufficient to maintain said ribbon in a coiled condition but insufficient to prevent progressive dispensing thereof . . . each annular sheet being comprised of paperboard having a coating of pressure-sensitive adhesive on one surface thereof, said ribbon being adapted for use in forming decorative stripes on motor vehicle bodies.

6. A method of packaging a ribbon of thin non-adhesive material to permit dispensing thereof, comprising the steps of:

forming coils of said ribbon into a roll, the edges of said coils being substantially aligned to a substantially flat non-adhesive surface on one side of said roll, and pressing a flat adhesive surface of a member having a pressure sensitive adhesive layer into adherence with said flat surface, the adherence of said flat adhesive surface to said edges being sufficient to maintain said ribbon in a coiled condition and to permit re-adherence thereto but insufficient to prevent progressive dispensing thereof.

7. A method as set forth in claim 6, wherein said member is a sheet adapted to be pressed into adherence with a major portion of said flat surface.

* * * * *